US009617997B2

(12) United States Patent
Uekawa

(10) Patent No.: US 9,617,997 B2
(45) Date of Patent: Apr. 11, 2017

(54) SCROLL COMPRESSOR WITH BALANCING WEIGHTS ON THE SHAFT

(71) Applicant: DAIKIN INDUSTRIES, LTD., Osaka-shi, Osaka (JP)

(72) Inventor: Takashi Uekawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 410 days.

(21) Appl. No.: 14/348,497

(22) PCT Filed: Sep. 27, 2012

(86) PCT No.: PCT/JP2012/006188
§ 371 (c)(1),
(2) Date: Mar. 28, 2014

(87) PCT Pub. No.: WO2013/046692
PCT Pub. Date: Apr. 4, 2013

(65) Prior Publication Data

US 2014/0248169 A1 Sep. 4, 2014

(30) Foreign Application Priority Data

Sep. 30, 2011 (JP) ..... 2011-218356

(51) Int. Cl.
*F04C 29/00* (2006.01)
*F04C 23/00* (2006.01)
*F04C 18/02* (2006.01)

(52) U.S. Cl.
CPC ..... *F04C 29/0021* (2013.01); *F04C 18/0215* (2013.01); *F04C 23/008* (2013.01); *F04C 2230/605* (2013.01); *F04C 2240/601* (2013.01)

(58) Field of Classification Search
CPC F04C 29/0021; F04C 18/0215; F04C 23/008; F04C 2230/605; F04C 15/0042
(Continued)

(56) References Cited

U.S. PATENT DOCUMENTS 5,403,171 A 4/1995 Sugita et al.
5,951,269 A 9/1999 Sasa et al.
(Continued)

FOREIGN PATENT DOCUMENTS

JP 6-66268 A 3/1994
JP 6-317263 A 11/1994
(Continued)

OTHER PUBLICATIONS

International Preliminary Report of corresponding PCT Application No. PCT/JP2012/006188 dated Apr. 21, 2014.
(Continued)

*Primary Examiner* — William H Rodriguez
*Assistant Examiner* — Christopher Brunjes
(74) *Attorney, Agent, or Firm* — Global IP Counselors, LLP

(57) ABSTRACT

A scroll compressor includes a compression mechanism, a crankshaft, and a drive motor. The compression mechanism has a fixed scroll and a movable scroll and is configured to compress a fluid. The crankshaft has a main shaft and an eccentric portion eccentrically disposed at one end of the main shaft and coupled to a back side of the movable scroll. The drive motor has a stator and a rotor coupled to the main shaft of the crankshaft to rotate the movable scroll. At least one of the main shaft of the crankshaft and the rotor of the drive motor is provided with a weight. The weight being is arranged to balance a centrifugal force of the movable scroll during rotation, and to reduce warpage of the crankshaft caused by balancing the centrifugal force of the movable scroll.

4 Claims, 6 Drawing Sheets

(58) Field of Classification Search
USPC ..... 417/410.5; 418/55.1, 151
See application file for complete search history.

(56) References Cited

U.S. PATENT DOCUMENTS

| | | | | |
|---|---|---|---|---|
| 2003/0012672 | A1* | 1/2003 | Sowa | F04C 18/0207 418/151 |
| 2008/0292484 | A1* | 11/2008 | Suh | F04C 18/0215 418/55.3 |

FOREIGN PATENT DOCUMENTS

| | | | |
|---|---|---|---|
| JP | 8-312542 | A | 11/1996 |
| JP | 10-61569 | A | 3/1998 |
| JP | 10-82379 | A | 3/1998 |
| JP | 2002-332976 | A | 11/2002 |
| JP | 2004-270654 | A | 9/2004 |
| JP | 2005-188516 | A | 7/2005 |
| JP | 2006-2823 | A | 1/2006 |
| WO | 2008/115016 | A1 | 9/2008 |

OTHER PUBLICATIONS

International Search Report of corresponding PCT Application No. PCT/JP2012/006188.
European Search Report of corresponding EP Application No. 12 83 4711.9 dated Mar. 13, 2015.

* cited by examiner

SCROLL COMPRESSOR WITH BALANCING WEIGHTS ON THE SHAFT

CROSS-REFERENCE TO RELATED APPLICATIONS

This U.S. National stage application claims priority under 35 USC. §119(a) to Japanese Patent Application No. 2011-218356, filed in Japan on Sep. 30, 2011, the entire contents of which are hereby incorporated herein by reference.

TECHNICAL FIELD

The present invention relates to scroll compressors, and specifically relates to reducing a reduction in bearing strength in the case where a crankshaft is rotated at a high speed.

BACKGROUND ART

Scroll compressors in which a fixed scroll and a movable scroll are engaged with each other, thereby forming a compression chamber, have been known. For example, Japanese Unexamined Patent Publication No. H10-61569 discloses a scroll compressor of this type. The scroll compressor includes a crankshaft having a main shaft and an eccentric portion that is eccentrically provided at one end of the main shaft, and a movable scroll is coupled to the eccentric portion of the crankshaft. When the crankshaft is rotated, the movable scroll is eccentrically rotated, allowing a low-pressure refrigerant to be sucked and compressed in a compression chamber and discharged to the outside as a high-pressure refrigerant.

SUMMARY

Technical Problem

In the conventional scroll compressor, a flow rate of a compressed refrigerant can be increased by increasing the number of revolutions of the crankshaft. However, if the number of revolutions of the crankshaft is increased, centrifugal forces of the movable scroll, the balancing weight, and the counterweight become accordingly large, which causes significant warpage of the crankshaft. This increases abrasion of the bearing supporting the crankshaft and reduces the bearing strength.

The present invention is thus intended to reduce a reduction in bearing strength in the case where a crankshaft is rotated at a high speed.

Solution to the Problem

The first aspect of the present disclosure is intended for a scroll compressor having: a compression mechanism (20) having a fixed scroll (21) and a movable scroll (31) and configured to compress a fluid; a crankshaft (40) having a main shaft (41) and an eccentric portion (42) eccentrically provided at one end of the main shaft (41) and coupled to a back side of the movable scroll (31); and a drive motor (50) having a stator (51) and a rotor (52) coupled to the main shaft (41) of the crankshaft (40), and configured to rotate the movable scroll (31). At least one of the main shaft (41) of the crankshaft (40) or the rotor (52) of the drive motor (50) is provided with a weight (80) which balances a centrifugal force of the movable scroll (31) during rotation, and reduces warpage of the crankshaft (40) caused by balancing the centrifugal force of the movable scroll (31).

In the first aspect of the present disclosure, the centrifugal force of the weight (80) provided on at least one of the main shaft (41) or the rotor (52) balances the centrifugal force of the movable scroll (31) during rotation, and reduces warpage of the crankshaft (40) caused by balancing the centrifugal force of the movable scroll (31). Thus, even when the number of revolutions of the crankshaft (40) is high, warpage of the crankshaft (40) is not increased. As a result, excessively high contact pressure is prevented from being locally generated due to uneven contact of the crankshaft (40) with the bearings, thereby reducing abrasion of the bearings.

The second aspect of the present disclosure is that in the first aspect of the present disclosure, the weight (80) includes a balancing weight (81, 82) which balances the centrifugal force of the movable scroll (31) during rotation, and a warpage reducing weight (91, 92, 93) which reduces warpage of the crankshaft (40) caused by balancing the centrifugal force of the movable scroll (31) and a centrifugal force of the balancing weight (81, 82). The balancing weight (81, 82) includes a first balancing weight (81) of which a center of gravity is located opposite to the eccentric portion (42) relative to an axial center of the main shaft (41), and a second balancing weight (82) which is father from the eccentric portion (42) than the first balancing weight (81) is, and of which a center of gravity is located on a same side where the eccentric portion (42) is positioned, relative to the axial center of the main shaft (41). The warpage reducing weight (91, 92, 93) includes an upper warpage reducing weight (91) which is provided at an upper portion of the main shaft (41) and of which a center of gravity is located opposite to the eccentric portion (42) relative to the axial center of the main shaft (41), a middle warpage reducing weight (92) which is provided at a middle portion of the main shaft (41) and of which a center of gravity is located on a same side where the eccentric portion (42) is positioned relative to the axial center of the main shaft (41), and a lower warpage reducing weight (93) which is provided at a lower portion of the main shaft (41) and of which a center of gravity is located opposite to the eccentric portion (42) relative to the axial center of the main shaft (41), and the upper warpage reducing weight (91), the middle warpage reducing weight (92), and the lower warpage reducing weight (93) are balanced with one another.

In the second aspect of the present disclosure, the first balancing weight (81) and the second balancing weight (82) are provided as the weight (80). When the crankshaft (40) is rotated, the centrifugal force of the first balancing weight (81) is generated in the direction opposite to the eccentric direction of the eccentric portion (42), and the centrifugal force of the second balancing weight (82) is generated in the same direction as the eccentric direction of the eccentric portion (42). When these two centrifugal forces are applied to the main shaft (41), a force opposite to the eccentric direction of the eccentric portion (42), that is, opposite to the centrifugal force of the movable scroll (Si) is applied to the eccentric portion (42) to balance the centrifugal force of the movable scroll (31).

In the scroll compressor (1), when the number of revolutions of the crankshaft (40) is increased, the centrifugal forces of the movable scroll (31), the first balancing weight (81), and the second balancing weight (82) are also increased. Thus, the crankshaft (40) is forced to warp significantly by the centrifugal forces. However, in the second aspect of the present disclosure, the three warpage reducing weights (91, 92, 93) in addition to the balancing weights (81, 82) are provided as the weight (80). When the crankshaft (40) is rotated, the centrifugal force of the upper warpage reducing weight (91) is generated in the direction opposite to the eccentric direction of the eccentric portion (42). Further, the centrifugal force of the middle warpage reducing weight (92) is generated in the same direction as the eccentric direction of the eccentric portion (42), and the centrifugal force of the lower warpage reducing weight (93) is generated in the direction opposite to the eccentric direction of the eccentric portion (42). The applying directions are opposite between the centrifugal force of the upper warpage reducing weight (91) and the centrifugal force of the movable scroll (31), between the centrifugal force of the middle warpage reducing weight (92) and the centrifugal force of the first balancing weight (81), and between the centrifugal force of the lower warpage reducing weight (93) and the centrifugal force of the second balancing weight (82). This means that the centrifugal forces of the three warpage reducing weights (91, 92, 93) are applied such that warpage of the crankshaft (40) caused by the centrifugal forces of the movable scroll (31), the first balancing weight (81), and the second balancing weight (82) is reduced.

The third aspect of the present disclosure is that in the second aspect of the present disclosure, at least one of the first balancing weight (81) or the second balancing weight (82) is integrally formed with any one of the upper warpage reducing weight (91), the middle warpage reducing weight (92), and the lower warpage reducing weight (93).

In the third aspect of the present disclosure, it is possible to reduce the number of parts and assembly steps.

The fourth aspect of the present disclosure is that in the first aspect of the present disclosure, the weight (80) generates, during rotation, a first force and a second force which balance the centrifugal force of the movable scroll (31), and a third force, a fourth force, and a fifth force which reduce warpage of the crankshaft (40) caused by balancing the centrifugal force of the movable scroll (31) with the first force and the second force and which are balanced with one another. The weight (80) includes an upper weight (101) which is provided at an upper portion of the main shaft (41) and generates the third force as a centrifugal force thereof, a middle weight (102) which is provided at a middle portion of the main shaft (41) and generates a total force of the first force and the fourth force as a centrifugal force thereof, and a lower weight (103) which is provided a lower portion of the main shaft (41) and generates a total force of the second force and the fifth force as a centrifugal force thereof.

In the fourth aspect of the present disclosure, the three weights (101, 102, 103) generate two forces which balance the centrifugal force of the movable scroll (30 during rotation, and three forces which reduce warpage of the crankshaft (40). This state is the same as the state in which the crankshaft (40) is rotated with the two balancing weights (81, 82) and three warpage reducing weights (91, 92, 93) provided at the main shaft (41). Thus, in the fourth aspect of the present disclosure, as well, a state is created in which the centrifugal force of the movable scroll (31) is balanced and warpage of the crankshaft (40) is reduced.

The fifth aspect of the present disclosure is that in the first aspect of the present disclosure, the weight (80) generates, during rotation, a first force and a second force which balance the centrifugal force of the movable scroll (31), and a third force, a fourth force, and a fifth force which reduce warpage of the crankshaft (40) caused by balancing the centrifugal force of the movable scroll (31) with the first force and the second force and which are balanced with one another. The weight (80) includes an upper weight (101) which is provided at an upper portion of the main shaft (41) and generates a total force of the first force and the third force as a centrifugal force thereof, a middle weight (102) which is provided at a middle portion of the main shaft (41) and generates the fourth force as a centrifugal force thereof, and a lower weight (103) which is provided at a lower portion of the main shaft (41) and generates a total force of the second force and the fifth force as a centrifugal force thereof.

In the fifth aspect of the present disclosure, the three weights (101, 102, 103) generate two forces which balance the centrifugal force of the movable scroll (31) during rotation, and three forces which reduce warpage of the crankshaft (40). This state is the same as the state in which the crankshaft (40) is rotated with two balancing weights (81, 82) and three warpage reducing weights (91, 92, 93) provided at the main shaft (41). Thus, in the fifth aspect of the present disclosure, as well, a state is created in which the centrifugal force of the movable scroll (31) is balanced and warpage of the crankshaft (40) is reduced.

Advantages of the Invention

According to the present invention, at least one of the main shaft (41) of the crankshaft (40) or the rotor (52) of the drive motor (50) is provided with the weight (80) which balances the centrifugal force of the movable scroll (31) during rotation and which reduces warpage of the crankshaft (40) caused by balancing the centrifugal force of the movable scroll (31). It is therefore possible to reduce an increase in warpage of the crankshaft (40) when the number of revolutions of the crankshaft (40) is high. As a result, abrasion of the bearings can be reduced during high-speed rotation, and a reduction in bearing strength due to the abrasion can be reduced, compared to the conventional cases.

According to the second aspect of the present disclosure, the two balancing weights (81, 82) and the three warpage reducing weights (91, 92, 93) are provided as the weight (80). By providing the balancing weights (81, 82) and the warpage reducing weights (91, 92, 93) separately, it is possible to reliably create a state in which the centrifugal force of the movable scroll (31) is balanced and warpage of the crankshaft (40) is reduced.

According to the third aspect of the present disclosure, at least one of the first balancing weight (81) or the second balancing weight (82) is integrally formed with any one of the upper warpage reducing weight (91), the middle warpage reducing weight (92) and the lower warpage reducing weight (93). Thus, it is possible to reduce the number of parts and assembly steps, thereby making it possible to reduce costs of the scroll compressor (1).

According to the fourth aspect of the present disclosure, the upper weight (101), the middle weight (102), and the lower weight (103) are provided as the weight (80) to generate two forces which balance the centrifugal force of the movable scroll (1) during rotation, and three forces which reduce warpage of the crankshaft (40). This state is the same as the state in which the crankshaft (40) is rotated with the two balancing weights (81, 82) and the three warpage reducing weights (91, 92, 93) provided at the main shaft (41). Thus, abrasion of the bearings during high-speed rotation can be reduced and a reduction in bearing strength can accordingly be reduced in the fourth aspect of the present disclosure, as well. Further, a total weight and a total volume of the weights can be smaller, compared to the case in which two balancing weights (81, 82) and three warpage reducing weights (91, 92, 93) are provided. Thus, it is possible to reduce the weight of the scroll compressor (1) and reduce space for locating the weights, thereby reducing the size of the scroll compressor (1).

According to the fifth aspect of the present disclosure, the upper weight (101), the middle weight (102), and the lower weight (103) are provided as the weight (80) to generate two forces which balance the centrifugal force of the movable scroll (31) during rotation and three forces which reduce warpage of the crankshaft (40). This state is the same as the state in which the crankshaft (40) is rotated with two balancing weights (81, 82) and three warpage reducing weights (91, 92, 93) provided at the main shaft (41). Thus, abrasion of the bearings during high-speed rotation can be reduced and a reduction in bearing strength can accordingly be reduced in the fifth aspect of the present disclosure, as well. Further, a total weight and a total volume of the weights can be smaller, compared to the case in which two balancing weights (81, 82) and three warpage reducing weights (91, 92, 93) are provided. Thus, it is possible to reduce the weight of the scroll compressor (1) and reduce space for locating the weights, thereby reducing the size of the scroll compressor (1).

DESCRIPTION OF EMBODIMENTS

Embodiments of the present invention be described in detail below, based on the drawings. The following embodiments are merely preferred examples in nature, and are not intended to limit the scope, applications, and use of the invention.

First Embodiment of Invention

Figure 1:
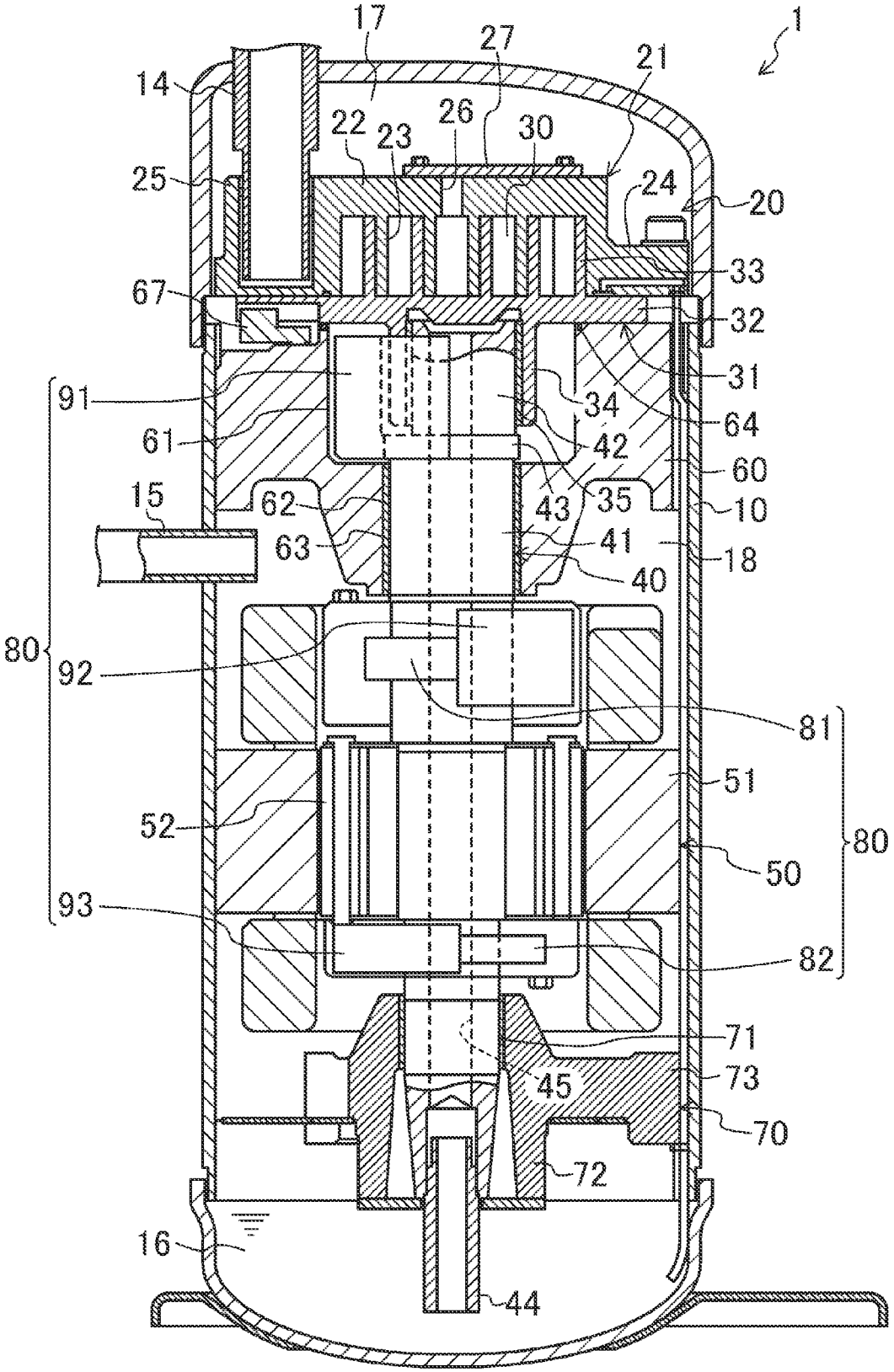
FIG. 1 is a vertical cross-section of a scroll compressor of the first embodiment.

A scroll compressor (1) of the present embodiment is connected, for example, to a refrigerant circuit (not shown) which performs a refrigeration cycle, and compresses a refrigerant. As shown in FIG. 1, the scroll compressor (1) includes a casing (10), compression mechanism (20), a housing (60), a drive motor (50), a lower bearing portion (70) and a crankshaft (40).

The casing (10) is a cylindrically-shaped closed container with a vertically-extending axis. The compression mechanism (20), the housing (60), the drive motor (50), and the lower bearing portion (70) are arranged in the casing (10) sequentially from top to bottom. The crankshaft (40) is arranged in the casing (10) so as to be along the axis of the casing (10).

A suction pipe (14) penetrates and is fixed to an upper portion of the casing (10), for guiding the refrigerant of the refrigerant circuit to the compression mechanism (20). A discharge pipe (15) penetrates and is fixed to a middle portion of the casing (10), for discharging the refrigerant in the casing (10) to the refrigerant circuit. An oil reservoir (16) in which lubricating oil is stored is provided at a lower portion of the casing (10).

The crankshaft (40) includes a main shaft (41), an eccentric portion (42), and an oil suction portion (44). The main shaft (41) is arranged to extend vertically, and the top end of the main shaft (41) is provided with a protrusion (43) of which the entire side surface protrudes from the main shaft (41) in a radial direction. The eccentric portion (42) is eccentrically provided on a top surface of the protrusion (43), that is, on the top end of the main shaft (41). The eccentric portion (42) is in a columnar shape and protrudes upward from the top surface of the protrusion (43), and the axial center thereof is eccentric with the axial center of the main shaft (41). The oil suction portion (44) is in a cylindrical shape, with its one end fixed to a lower portion of the main shaft (41), and the other end immersed in the oil reservoir (16). An oil supply path (45) is formed in the crankshaft (40). The oil supply path (45) penetrates from the oil suction portion (44) at the bottom to the eccentric portion (42) at the top end.

The compression mechanism (20) includes a fixed scroll (21) which is fixed to a top surface of the housing (60), and a movable scroll (31) which engages with the fixed scroll (21).

The fixed scroll (21) includes an end plate (22), a spiral (involute) lap (23) formed on the front surface (the bottom surface in FIG. 1) of the end plate (22), and an outer peripheral wall (24) which is located on the outer side of the lap (23) and which is continuous with the lap (23). The end surface of the outer peripheral wall (24) and the end surface of the lap (23) are approximately flush with each other. The fixed scroll (21) is brought into contact with the top surface of the housing (60) and is fixed. A suction port (25) is formed in the outer peripheral wall (24), and the suction pipe (14) is airtightly connected to the suction port (25). A discharge port (26) which penetrates the end plate (22) of the fixed scroll (21) in the thickness direction is formed in a central portion of the end plate (22). The opening of the discharge port (26) on the back side (the top surface in FIG. 1) of the end plate (22) is closed by a lid member (27). The discharge port (26) communicates with a lower space (18) under the housing (60) through a path (not shown) formed in the end plate (22) of the fixed scroll (21) and the housing (60).

Figure 2:
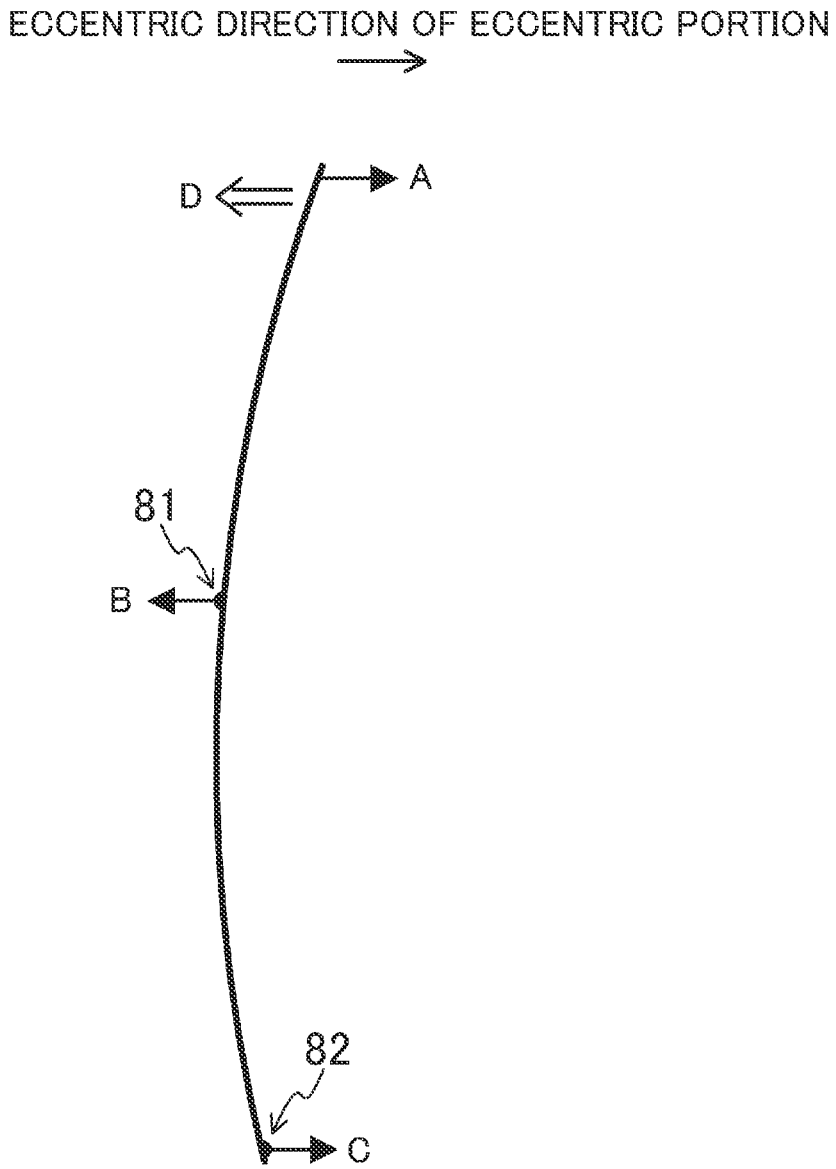
FIG. 2 is a diagram showing a relationship between centrifugal forces of a movable scroll and a balancing weight and warpage of a crankshaft caused by the centrifugal forces, in the scroll compressor of the first embodiment.

The movable scroll (31) includes an end plate (32) and a spiral (involute) lap (33) formed on the front surface (the top surface in FIG. 1) of the end plate (32). The lap (33) of the movable scroll (31) engages with the lap (23) of the fixed scroll (21). A compression chamber (30) that is a space formed by the two laps (23, 33) is formed between the end plate (22) of the fixed scroll (21) and the end plate (32) of the movable scroll (31). Further, a cylindrical boss (34) is integrally formed in a central portion of the back side of the end plate (32) of the movable scroll (31). A bearing (35) is press fitted in the boss (34). The eccentric portion (42) of the crankshaft (40) is rotatably supported by the bearing (35). As described above, the eccentric portion (42) is coupled to the back side of the movable scroll (31). Thus, as shown in FIG. 2, the movable scroll (31) is eccentrically rotated when the crankshaft (40) is rotated, and a centrifugal force A of the movable scroll (31) is applied to the eccentric portion (42) in an eccentric direction.

The housing (60) is in a bowl shape with an annular outer periphery and a recess (61) at a central portion of a top surface. The outer periphery of the housing (60) is press fitted to the casing (10) to provide airtight seal. Thus, the housing (60) partitions the interior of the casing (10) into an upper space (17) accommodating the compression mechanism (20), and the lower space (18) accommodating the drive motor (50).

The housing (60) has a through hole (62) which passes through the housing (60) from the bottom of the recess (61) to the lower end of the housing (60). An upper bearing (63) is press fitted in the through hole (62). An upper portion of the main shaft (41) is rotatably supported by the upper bearing (63).

Further, an annular sealing member (64) is provided in the top surface of the housing (60) at the outer peripheral edge of the recess (61). The sealing member (64) is held in contact with the back side of the end plate (32) of the movable scroll (31), and partitions the space on the back side of the movable scroll (31) into a space on the inner side of the sealing member (64) and a space on the outer side of the sealing member (64). The space on the inner side of the sealing member (64) is formed of the recess (61) and the oil supply path (45) which communicates with recess (61). On the other hand, the space on the outer side of the sealing member (64) is formed of a gap between the outer periphery of the housing (60) and the movable scroll (31). An Oldham coupling (67) for preventing rotation of the movable scroll (31) on its axis is provided in the space on the outer side of the sealing member (64). The Oldham coupling (67) is engaged with a key groove (not shown) formed in the back side of the end plate (32) of the movable scroll (31), and a key groove (not shown) formed in the top surface of the outer periphery of the housing (60).

The drive motor (50) includes a stator (51) and a rotor (52). The stator (51) is fixed to the casing (10) by shrinkage fit by heating, etc. The rotor (52) is positioned inside the stator (51) to be coaxial with the stator (51), and is fixed to the main shaft (41) of the crankshaft (40) by shrinkage fit by heating, etc.

The lower bearing portion (70) includes a tubular bearing holder (72) and a fixed portion (73) which protrudes outward from an outer circumferential surface of the bearing holder (72) and is fixed to the casing (10). A lower bearing (71) is press fitted in the bearing holder (72), and a lower portion of the main shaft (41) is rotatably supported by the lower bearing (71).

A first balancing weight (81) and a second balancing weight (82) are provided on the main shaft (41) of the crankshaft (40). The two balancing weights (81, 82) balance the centrifugal force A of the movable scroll (31) during rotation, and comprise part of the weight (80) of the present invention.

Each of the first balancing weight (81) and the second balancing weight (82) is C-shaped in plan view. The first balancing weight (81) is attached to a side surface of the main shaft (41) between the housing (60) and the rotor (52) (hereinafter referred to as a "middle portion" and the first balancing weight (81) is opposite to the eccentric portion (42) relative to the axial center of the main shaft (41). On the other hand, the second balancing weight (82) is attached to a side surface of the main shaft (41) between the rotor (52) and the lower bearing portion (70) (hereinafter referred to as a "lower portion"), and the second balancing weight (82) is opposite to the first balancing weight (81) relative to the axial center of the main shaft (41). The first balancing weight (81) is located such that the center of gravity thereof is opposite to the eccentric portion (42) relative to the axial center of the main shaft (41). The balancing weight (82) is located such that the center of gravity thereof is on the same side where the eccentric portion (42) is positioned, relative to the axial center of the main shaft (41).

When the crankshaft (40) with the two balancing weights (81, 82) attached thereto is rotated, a centrifugal force B of the first balancing weight (81) is generated in a direction opposite to the eccentric direction of the eccentric portion (42), and a centrifugal force C of the second balancing weight (82) is generated in the same direction as the eccentric direction of the eccentric portion (42), as shown in FIG. 2. When the two centrifugal forces B and C are applied to the main shaft (41), a force D in a direction opposite to the eccentric direction of the eccentric portion (42), that is, opposite to the centrifugal force A of the movable scroll (31) is applied to the eccentric portion (42) to balance the centrifugal force A of the movable scroll (31).

However, in the state in which the centrifugal force A of the movable scroll (31) and the centrifugal threes B and C of the two balancing weights (81, 82) are balanced, the centrifugal forces A. B and C are increased when, for example, the number of revolutions of the crankshaft (40) is high. As a result, the crankshaft (40) is forced to warp significantly.

In view of this, in the present embodiment, the main shaft (41) of the crankshaft (40) is provided with an upper warpage reducing weight (91), a middle warpage reducing weight (92), and a lower warpage reducing weight (93), as shown in FIG. 1. These three warpage reducing weights (91, 92, 93) reduce warpage of the crankshaft (40) caused by balancing the centrifugal force A of the movable scroll (31), and comprise part of the weight (80) of the present invention.

Each of the three warpage reducing weights (91, 92, 93) is C-shaped in plan view. The upper warpage reducing weight (91) is attached to a side surface of the protrusion (43) (hereinafter referred to as the upper portion), and the upper warpage reducing weight (91) is located opposite to the eccentric portion (42) relative to the axial center of the main shaft (41). The middle warpage reducing weight (92) is attached to a side surface of a middle portion of the main shaft (41), and the middle warpage reducing weight (92) is located opposite to the upper warpage reducing weight (91) relative to the axial center of the main shaft (41). The lower warpage reducing weight (93) is attached to a side surface of a lower portion of the main shaft (41), and the lower warpage reducing weight (93) is on the same side where the upper warpage reducing weight (91) is positioned, relative to the axial center of the main shaft (41). The upper warpage reducing weight (91) is located such that the center of gravity thereof is opposite to the eccentric portion (42) relative to the axial center of the main shaft (41). The middle warpage reducing weight (92) is located such that the center of gravity thereof is on the same side where the eccentric portion (42) is positioned relative to the axial center of the main shaft (41). The lower warpage reducing weight (93) is located such that the center of gravity thereof is opposite to the eccentric portion (42) relative to the axial center of the main shaft (41).

Figure 3:
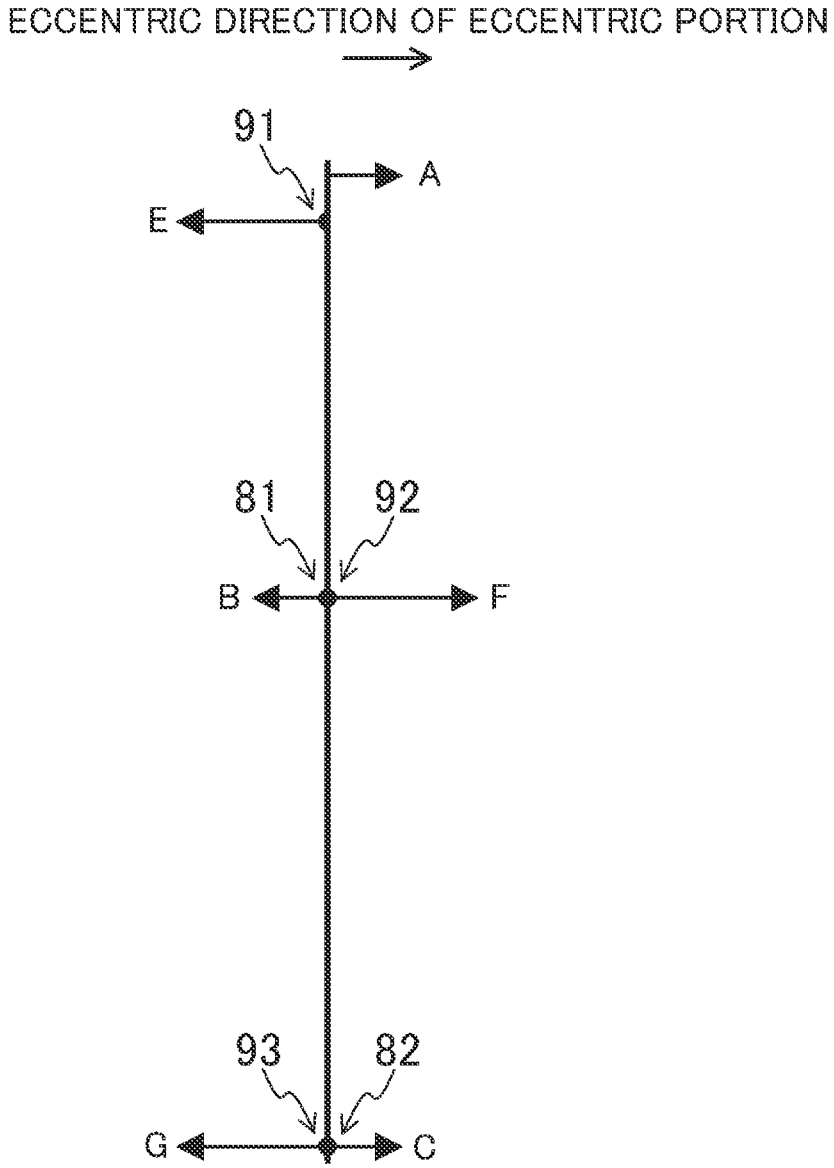
FIG. 3 is a diagram showing a relationship between centrifugal forces of the movable scroll, the balancing weight, and a warpage reducing weight, and warpage of the crankshaft caused by the centrifugal forces, in the scroll compressor of the first embodiment.

When the crankshaft (40) is rotated with the three warpage reducing weights (91, 92, 93) attached thereto, the centrifugal force E of the upper warpage reducing weight (91) is generated in a direction opposite to the eccentric direction of the eccentric portion (42) as shown in FIG. 3. Further, the centrifugal force F of the middle warpage reducing weight (92) is generated in the same direction as the eccentric direction of the eccentric portion (42), and the centrifugal force G of the lower warpage reducing weight (93) is generated in the direction opposite to the eccentric direction of the eccentric portion (42). The centrifugal forces E, F and G of the three warpage reducing weights (91, 92, 93) are balanced with one another. Further, the applying directions are opposite between the centrifugal force E and the centrifugal force A of the movable scroll (31), between the centrifugal force F and the centrifugal force B of the first balancing weight (81), and between the centrifugal force G and the centrifugal force C of the second balancing weight (82). This means that the centrifugal forces E, F and G of the three warpage reducing weights (91, 92, 93) are applied such that warpage of the crankshaft (40) caused by the centrifugal forces A, B and C is reduced. Thus, warpage of the crankshaft (40) can be reduced even in the case where the number of revolutions of the crankshaft (40) is high and the centrifugal forces A, B and C of the movable scroll (31) and the two balancing weights (91, 92) are large. As a result, excessively high contact pressure is prevented from being locally generated due to uneven contact of the crankshaft (40) with the bearings (63, 71), thereby reducing abrasion of the bearings (63, 71).

Advantages of Embodiments

In the present embodiment, the main shaft (41) of the crankshaft (40) is provided with the weight (80) to balance the centrifugal force A of the movable scroll (31) during rotation and to reduce warpage of the crankshaft (40) caused by balancing the centrifugal force A of the movable scroll (31). It is therefore possible to reduce warpage of the crankshaft (40) when the number of revolutions of the crankshaft (40) is high. As a result, abrasion of the bearings can be reduced during high-speed rotation, and a reduction in bearing strength due to the abrasion can be reduced, compared to the conventional cases.

Further, in the present embodiment, two balancing weights (81, 82) and three warpage reducing weights (91, 92, 93) are provided as the weight (80). Thus, it is possible to reliably create a state in which the centrifugal force A of the movable scroll (31) is balanced and warpage of the crankshaft (40) is reduced.

Variation of First Embodiment

The first embodiment may have the following configurations.

In the first embodiment, the first balancing weight (81) and the middle warpage reducing weight (92) are attached to the middle portion of the main shaft (41) (a portion between the housing (60) and the rotor (52)). However, the weight attachment location is not limited to the portion, and at least one of the two weights (81, 92) may be attached to the top surface of the rotor (52).

In the first embodiment, the second balancing weight (82) and the lower warpage reducing weight (93) are attached to the lower portion of the main shaft (41) (a portion between the rotor (52) and the lower bearing portion (70)). However, the weight attachment location is not limited to the portion, and at least one of the two weights (82, 93) may be attached to the bottom surface of the rotor (52).

In the first embodiment, each of the first balancing weight (81) and the second balancing weight (82) is C-shaped in plan view, and is attached to a side surface of the main shaft (41). However, the shape and the location are not limited to such a shape and a location, as long as the center of gravity of the first balancing weight (81) is located opposite to the eccentric portion (42) relative to the axial center of the main shaft (41) and the center of gravity of the second balancing weight (82) is located on the same side where the eccentric portion (42) is positioned, relative to the axial center of the main shaft (41).

In the first embodiment, each of the upper warpage reducing weight (91), the middle warpage reducing weight (92), and the lower warpage reducing weight (93) is C-shaped in plan view, and is attached to a side surface of the main shaft (41). However, the shape and the location are not limited to such a shape and a location, as long as the center of gravity of the upper warpage reducing weight (91) is located opposite to the eccentric portion (42) relative to the axial center of the main shaft (41); the center of gravity of the middle warpage weight (92) is located on the same side where the eccentric portion (42) is positioned, relative to the axial center of the main shaft (41); and the center of gravity of the lower warpage reducing weight (93) is located opposite to the eccentric portion (42) relative to the axial center of the main shaft (41).

In the first embodiment, the first balancing weight (81) is provided at the middle portion of the main shaft (41). However, the location is not limited to this portion. For example, the first balancing weight (81) may be provided at the upper portion of the main shaft (41) to apply the centrifugal three B during rotation.

In the first embodiment, the two balancing weights (81, 82) and the three warpage reducing weights (91, 92, 93) are separately provided. Ho ever, the configuration is not limited to this configuration, and the first balancing weight (81) and the middle warpage reducing weight (92) may be integrally formed, for example. If any one of the balancing weights (81, 82) and any one of the warpage reducing weights (91, 92, 93) are integrally formed, the number of parts and assembly steps can be reduced, and costs of the scroll compressor (1) can be reduced.

Second Embodiment

Figure 4:
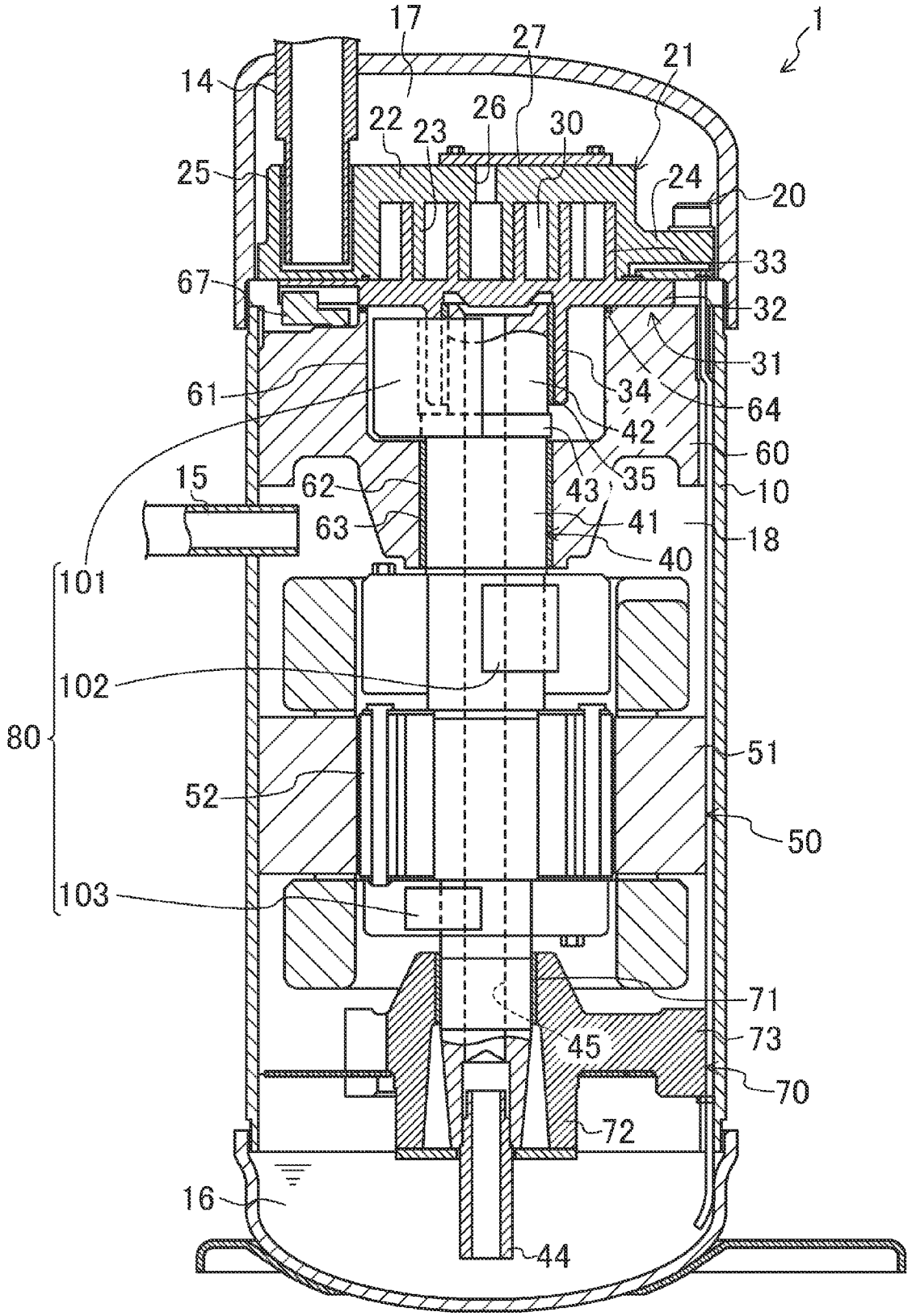
FIG. 4 is a vertical cross-section of a scroll compressor of the second embodiment.

Now, the second embodiment of the present invention will be described in detail, based on the drawings. In the second embodiment, the number of weights in the first embodiment has been changed. That is, there are five weights (81, 82 and 91-93) provided on the main shaft (41) in the first embodiment, whereas in the second embodiment, three weights (101, 102, 103) are provided as shown in FIG. 4

Figure 5:
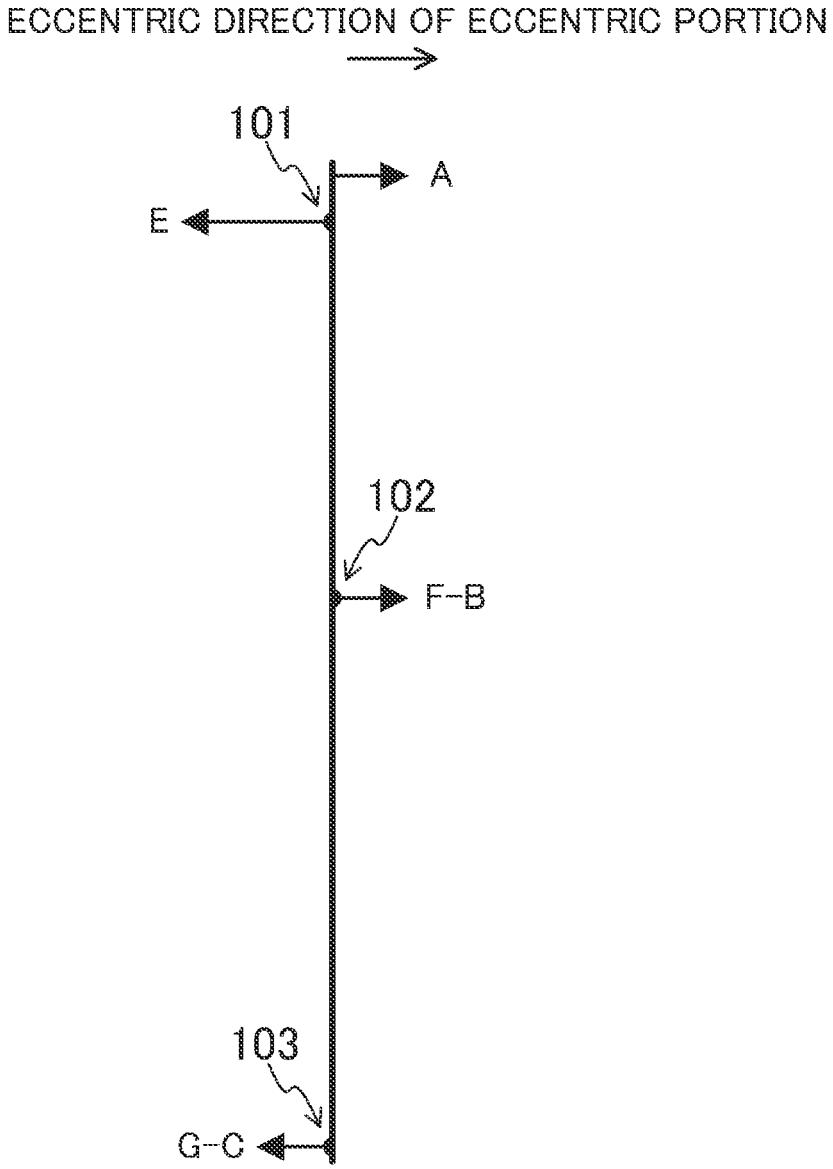
FIG. 5 is a diagram showing a relationship between centrifugal forces of a movable scroll and weights and warpage of a crankshaft caused by the centrifugal forces, in the scroll compressor of the second embodiment.

The main shaft (41) of the crankshaft (40) is provided with an upper weight (101), a middle weight (102), and a lower weight (103). Each of the three weights (101, 102, 103) is C-shaped in plan view. The upper weight (101) is attached to a side surface of the upper portion of the main shaft (41), and opposite to the eccentric portion (42) relative to the axial center of the main shaft (41). As shown in FIG. 5, the upper weight (101) is configured to generate, during rotation, a centrifugal force E which has the same magnitude as the centrifugal force E of the upper warpage reducing weight (91) of the first embodiment. The middle weight (102) is attached to a side surface of a middle portion of the main shaft (41), and is opposite to the upper weight (100 relative to the axial center of the main shaft (41). The middle weight (102) is configured to generate, during rotation, a centrifugal force F−B which has the same magnitude as a total force obtained by subtracting the centrifugal force B of the first balancing weight (81) from the centrifugal force F of the middle warpage reducing weight (92) of the first embodiment. The lower weight (103) is attached to a side surface of a lower portion of the main shaft (41), and on the same side where the upper weight (101) is positioned, relative to the axial center of the main shaft (41). The lower weight (103) is configured to generate, during rotation, a centrifugal force G-C which has the same magnitude as a total force obtained by subtracting the centrifugal force C of the second balancing weight (82) from the centrifugal force G of the lower warpage reducing weight (93) of the first embodiment. The centrifugal force B, the centrifugal force C, the centrifugal force E, the centrifugal force F, and the centrifugal force G comprise the first force, the second force, the third force, the fourth force, and the fifth force of the present invention, respectively.

In the second embodiment, a state similar to the state of the first embodiment is created. Specifically, a state is created in which two centrifugal forces B and C are applied to balance the centrifugal force A of the movable scroll (31), and in which three centrifugal forces E, F and G are applied to reduce warpage of the crankshaft (40). Thus, similar to the first embodiment, abrasion of the bearing during high-speed rotation can be reduced and a reduction in bearing strength can accordingly be reduced in the second embodiment, as well. Further, a total weight and a total volume of the weights can be smaller than those in the first embodiment, and therefore, it is possible to reduce the weight of the scroll compressor (1) and reduce space for locating the weights, thereby reducing the size of the scroll compressor (1).

Variation of Second Embodiment

The second embodiment may have the following configurations.

In the second embodiment, the middle weight (102) is attached to the middle portion of the main shaft (41) (a portion between the housing (60) and the rotor (52)). However, the middle weight (102) may be attached to the top surface of the rotor (52). Further, the lower weight (103) is attached to the lower portion of the main shaft (41) (a portion between the rotor (52) and the lower bearing portion (70)). However, the lower weight (103) may be attached to the bottom surface of the rotor (52).

In the second embodiment, each of the three weights (101, 102, 103) is C-shaped in plan view, but the shape is not limited to the C-shape.

In the second embodiment, an example in which the centrifugal force F is greater than the centrifugal force B, and the centrifugal force G is greater than the centrifugal force C, is described. However, the configuration is not limited to this configuration, and in the case where the centrifugal force F is smaller than the centrifugal force B, and the centrifugal force G is smaller than the centrifugal force C, the middle weight (102) may be provided on the same side where the upper weight (101) is positioned, relative to the axial center of the main shaft (41), and the lower weight (103) may be provided to be opposite to the upper weight (101), relative to the axial center of the main shaft (41).

Figure 6:
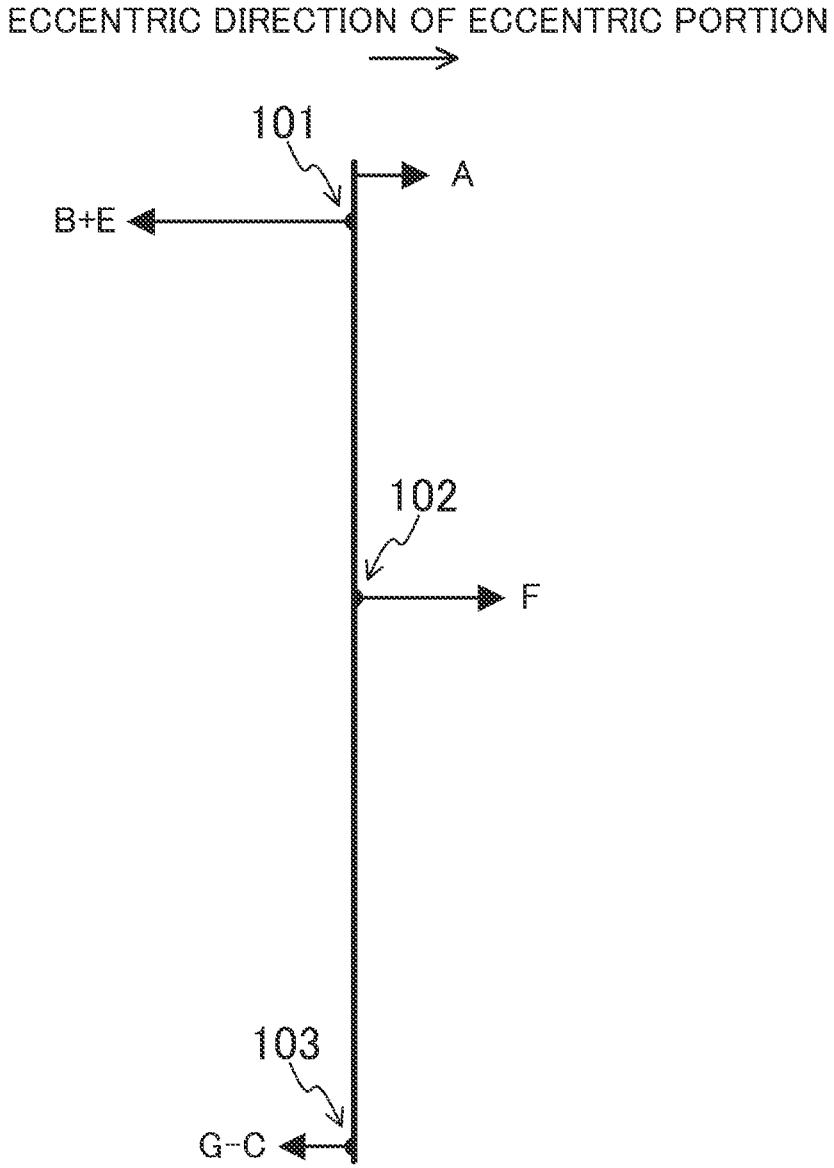
FIG. 6 is a diagram showing a relationship between centrifugal forces of the movable scroll and weights and warpage of the crankshaft caused by the centrifugal forces, in a scroll compressor of a variation of the second embodiment.

In the second embodiment, the upper weight (101) which generates the centrifugal force E during rotation, and the middle weight (102) which generates the total force F−B of the centrifugal force F and the centrifugal force B during rotation are provided. However, the configurations of the upper weight (101) and the middle weight (102) are not limited to these configurations, and the upper weight (101) may generate a total force B+E of the centrifugal force B and the centrifugal force E during rotation, and the middle weight (102) may generate the centrifugal force F during rotation, as shown in FIG. 6.

INDUSTRIAL APPLICABILITY

As described above, the present invention is useful as a scroll compressor which is connected to a refrigerant circuit performing a refrigeration cycle, and compresses a refrigerant.

1 scroll compressor
20 compression mechanism
21 fixed scroll
31 movable scroll
40 crankshaft
41 main shaft
42 eccentric portion
50 drive motor
52 rotor
80 weight
81 first balancing weight
82 second balancing weight
91 upper warpage reducing weight
92 middle warpage reducing weight
93 lower warpage reducing weight
101 upper weight
102 middle weight
103 lower weight

What is claimed is:

1. A scroll compressor, comprising:

a compression mechanism having a fixed scroll and a movable scroll and being configured to compress a fluid;

a crankshaft having a main shaft and an eccentric portion eccentrically disposed at one end of the main shaft and coupled to a back side of the movable scroll; and a drive motor having a stator and a rotor coupled to the main shaft of the crankshaft to rotate the movable scroll, at least one of the main shaft of the crankshaft and the rotor of the drive motor being provided with a weight, the weight being arranged to balance a centrifugal force of the movable scroll during rotation, and to reduce warpage of the crankshaft caused by balancing the centrifugal force of the movable scroll, and the weight including a balancing weight arranged to balance the centrifugal force of the movable scroll during rotation, and a warpage reducing weight arranged to reduce warpage of the crankshaft caused by balancing the centrifugal force of the movable scroll and a centrifugal force of the balancing weight, the balancing weight including a first balancing weight having a center of gravity located opposite to the eccentric portion relative to an axial center of the main shaft, and a second balancing weight farther from the eccentric portion than the first balancing weight and having a center of gravity located on a same side as where the eccentric portion is positioned, relative to the axial center of the main shaft, and the warpage reducing weight including an upper warpage reducing weight disposed at an upper portion of the main shaft and having a center of gravity located opposite to the eccentric portion relative to the axial center of the main shaft, a middle warpage reducing weight disposed at a middle portion of the main shaft and having a center of gravity located on the same side as where the eccentric portion is positioned, relative to the axial center of the main shaft, and a lower warpage reducing weight disposed at a lower portion of the main shaft and having a center of gravity located opposite to the eccentric portion relative to the axial center of the main shaft, the upper warpage reducing weight, the middle warpage reducing weight, and the lower warpage reducing weight being balanced with one another.

2. The scroll compressor of claim 1, wherein at least one of the first balancing weight and the second balancing weight is integrally formed with any one of the upper warpage reducing weight, the middle warpage reducing weight, and the lower warpage reducing weight.

3. The scroll compressor of claim 1, wherein the weight is arranged to generate, during rotation, a first force and a second force, which balance the centrifugal force of the movable scroll, and a third force, a fourth force, and a fifth force, which reduce warpage of the crankshaft caused by balancing the centrifugal force of the movable scroll with the first force and the second force and which are balanced with one another, and the weight is arranged to generate the third force as a centrifugal force thereof, a total force of the first force and the fourth force as a centrifugal force thereof, and a total force of the second force and the fifth force as a centrifugal force thereof.

4. The scroll compressor of claim 1, wherein the weight is arranged to generate, during rotation, a first force and a second force, which balance the centrifugal force of the movable scroll, and a third force, a fourth force, and a fifth force, which reduce warpage of the crankshaft caused by balancing the centrifugal force of the movable scroll with the first force and the second force and which are balanced with one another, and the weight is arranged to generate a total force of the first force and the third force as a centrifugal force thereof, the fourth force as a centrifugal force thereof, and a total force of the second force and the fifth force as a centrifugal force thereof.

* * * * *